United States Patent [19]

Bareham

[11] 3,941,102

[45] Mar. 2, 1976

[54] BUCKET TAPPETS

[75] Inventor: Eric Gordon Bareham, Rednal, England

[73] Assignee: British Leyland UK Limited, London, England

[22] Filed: Aug. 16, 1974

[21] Appl. No.: 498,248

[52] U.S. Cl. ..... 123/90.52; 74/569; 123/90.67

[51] Int. Cl.[2] ..... F01L 1/14

[58] Field of Search ..... 74/569; 123/90.52, 90.67, 123/90.48, 90.5, 90.47, 90.27, 90.65, 90.16, 90.2, 90.26, 90.28

[56] References Cited

UNITED STATES PATENTS

| | | | |
|---|---|---|---|
| 1,857,005 | 5/1932 | Schotthoefer | 123/90.52 |
| 3,301,239 | 1/1967 | Thauer | 123/90.67 |
| 3,413,964 | 12/1968 | Pask | 74/569 |
| 3,675,631 | 7/1972 | Hixson | 74/569 |
| 3,752,130 | 8/1973 | Scheibe | 74/569 |
| 3,880,128 | 4/1975 | Stirrat | 123/90.52 |

*Primary Examiner*—Wendell E. Burns
*Assistant Examiner*—Daniel J. O'Connor
*Attorney, Agent, or Firm*—Brisebois & Kruger

[57] ABSTRACT

A poppet valve assembly for an internal combustion engine, in which a tappet foot is in screw thread engagement with the end of a valve stem; a retainer collar non-rotatably engages both the valve stem and the tapper foot; and a valve return spring acting on the retainer collar must be compressed in order to disengage the collar from the foot for adjustment of the valve operating clearance.

5 Claims, 5 Drawing Figures

BUCKET TAPPETS

This invention relates to a poppet valve assembly that includes an adjustable tappet, and more particularly to features of the tappet itself.

In an internal combustion engine with an overhead camshaft layout it is usual for a tappet to be interposed directly between the end of a poppet valve stem and the camshaft. Adjustment of the valve operating clearance is usually obtained either by grinding the tappet foot, or by means of shims. The shims can be inserted either between the end of the valve stem and the tappet, or between separate foot and body portions of the tappet.

None of the aforementioned methods of adjustment can be readily carried out as part of the routine servicing of an internal combustion engine. Grinding is a skilful operation and requires replacement of the tappet foot, and shims have a tendency to become thinned, or to break up, over a prolonged period of service. It is with facilitating the adjustment of poppet valve operating clearances and the avoidance of the last-mentioned problems that the invention is particularly concerned.

From one aspect the invention resides in a poppet valve assembly in which a tappet foot is in screw thread engagement with the end of a valve stem; a retainer collar non-rotatably engages both the valve stem and the tappet foot; and a valve return spring acting on the retainer collar must be compressed in order to disengage the collar from the foot for adjustment of the valve operating clearance.

More specifically, and from the same aspect, the invention resides in a poppet valve assembly in which a tappet foot is in screw thread engagement with the end of a valve stem and has locking formations; a retainer collar on the valve stem has locking formations which inter-engage the formations of the foot and which co-operatively afford a plurality of alternative angular settings for the foot; and the retainer collar non-rotatably engages a non-round section of the valve stem and is displaceable against a valve return spring in order to disengage it from the foot for adjustment of the valve operating clearance.

Adjustment of the valve operating clearance involves simply displacing the collar against the return spring so as to disengage it from the foot, and then turning one part (conveniently the foot) relative to the other portion through a predetermined angle corresponding to the required axial displacement of the foot on the screw thread of the valve stem. The two parts of the tappet, that is to say the collar and the foot, are then released to inter-engage in their new angular relationship under the action of the valve return spring.

From another aspect the invention resides in a tappet foot adapted to form part of the poppet valve assembly broadly defined above, having a screw thread for engaging the end of the poppet valve stem and further having locking formations for entering into non-rotatable engagement with the retainer collar as the collar and foot are brought co-axially together.

From yet another aspect the invention resides in a retainer collar adapted to form part of the poppet valve assembly broadly defined above, having a non-round central opening portion for non-rotatably engaging the valve stem and further having locking formations for entering into non-rotatable engagement with the tappet foot as the foot and collar are brought co-axially together.

The locking formations can comprise co-axial projections and recesses which inter-engage as the foot and collar are brought co-axially together by the action of the valve return spring. Such projections and recesses can, moreover, be tapered for wedging inter-engagement in order to avoid any play between them. Preferably, however, the retainer collar has a ring of radial locking formations concentrically inter-engaging a ring of radial locking formations of the tappet foot. The preferred arrangement has the advantage that the formations can be seen when adjusting the valve operating clearance.

In order to relieve the non-rotatably engagement between the retainer collar and valve stem of some of the stress in preventing rotation of the tappet on the stem, the friction in the screw thread engagement of the tappet spring is preferably increased by the action of the valve return spring. Conveniently, the tappet foot has an internally screw-threaded, tapered stem that nests within a complementary, tapered central-opening portion of the retainer collar, and the stem of the foot is split axially so that it can grip the thread of the valve stem radially. Alternatively, and to the same end, the tappet foot has an internally screw-threaded, cylindrical stem the end of which abuts an annular shoulder at the bottom of a cylindrical central-opening portion of the retainer collar, and the stem of the foot is slit circumferentially so that it can grip the thread of the valve stem axially.

Each of these two alternative embodiments utilizes the stresses imposed on the tappet foot by the valve return spring to take-up a tolerance in the screw thread engagement between the foot and valve stem. Such a tolerance is desirable in the first instance to facilitate the adjustment of the valve operating clearance.

The two preferred embodiments of the invention broadly described above will now be more particularly described, by way of example, with reference to the accompanying drawings in which.

Those features which are broadly common to both embodiments will first be described, using the same reference numerals for each embodiment.

Figure 1:
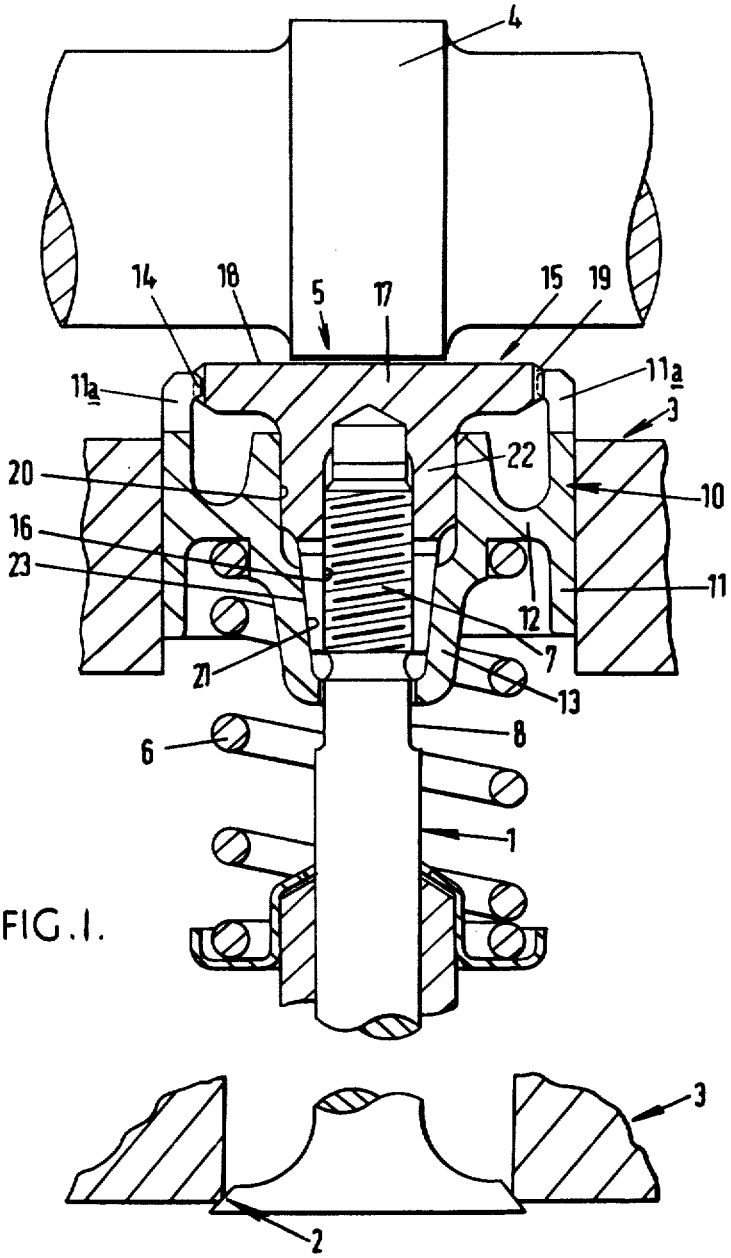
FIG. 1 is a diametric section of a first poppet valve assembly.

In each assembly a poppet valve 1 co-operates with a valve seat 2 in an internal combustion engine cylinder head 3 having an overhead camshaft 4 which acts through a two part adjustable tappet 5 against a helical valve return spring 6.

More particularly, each tappet comprises a collar or bucket portion 10 having an outer wall 11 integral, through an annular connecting portion 12, with an inner wall 13 that defines a central opening. The outer wall 11 and connecting portion 12 defines a recess in one end of the bucket portion 10, in which recess the wall 11 is formed with a ring of radially projecting teeth 14. The stem of a substantially mushroom-shaped foot or insert portion 15 of the tappet fits within the opening in the bucket portion 10, and has an internal axially developed screw-thread 16. The head 17 of the insert portion 15 defines a cam follower surface 18 and is formed around its periphery with a ring of teeth 19 which are complementary to those of the bucket portion 10. When the insert portion 15 is received in the opening of the bucket portion 10, as shown in FIGS. 1 and 2, and also in FIG. 3, the teeth 14, 19 inter-engage and prevent relative rotation between the two portions 10 and 15 of the tappet.

The foot or insert portion 15 of the tappet is shown in each Figure in co-axial screw-thread engagement with the valve stem 1 that has a threaded end portion 7 adjacent to which it is formed with two oppositely facing flats 8. The flats 8 co-operate with complementary chord portions in the opening of the bucket portion 10 so as to prevent relative rotation between the stem 1 and portion 10. The valve return spring 6 is shown acting in compression on the bucket portion 10, urging it to receive the insert portion 15.

Figure 3:
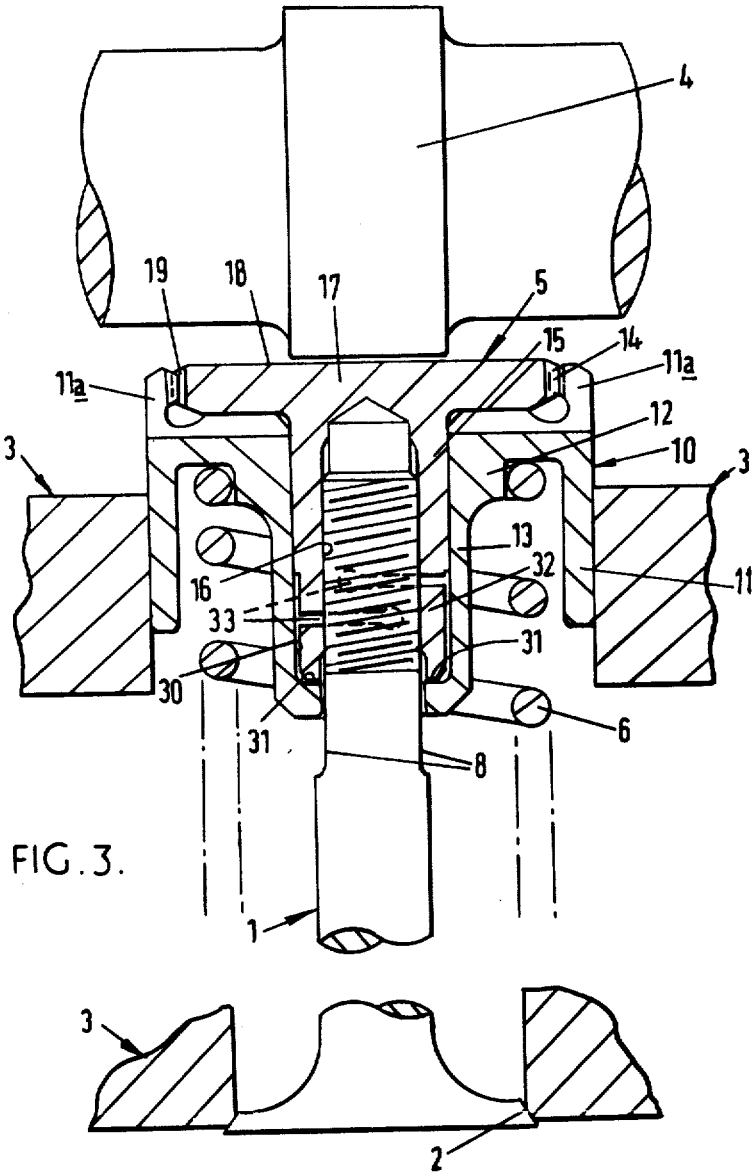
FIG. 3 is an illustration corresponding to FIG. 1, of a second poppet valve assembly.
Figure 4:
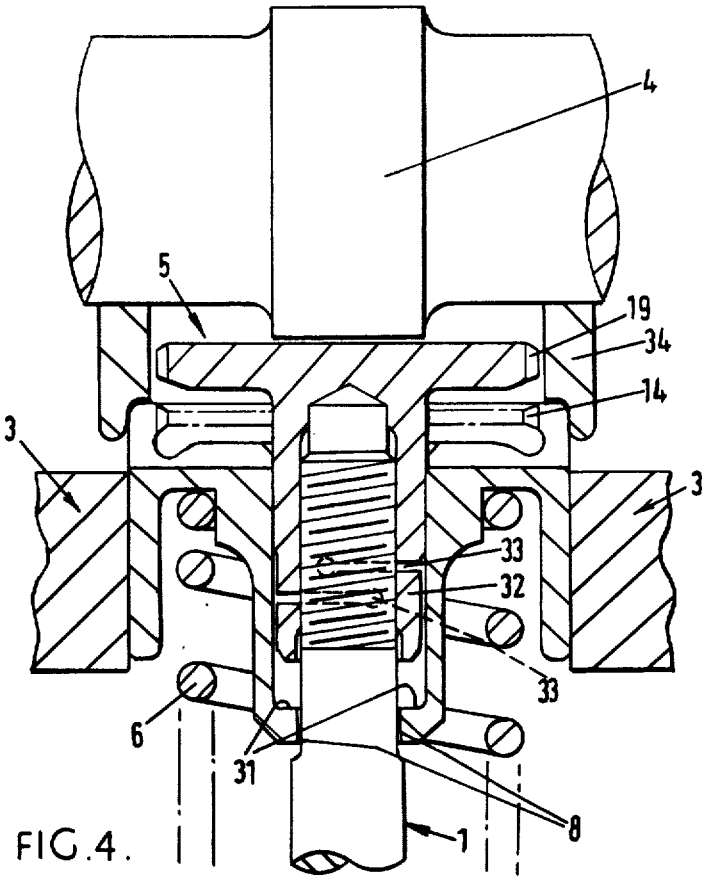
FIG. 4 is an illustration corresponding to FIG. 3, showing the tappet foot of the second poppet valve assembly axially displaced with respect to the retainer collar.
Figure 5:
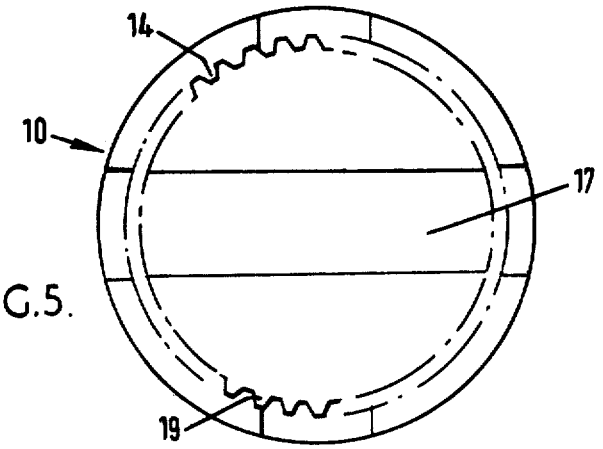
FIG. 5 is a plan view of a preferred tappet according to the invention, which can be either the tappet illustrated in FIGS. 1 and 2, or the tappet illustrated in FIGS. 3 and 4.

In order to facilitate disengagement of the bucket portion 10 from the foot or insert portion 15 for adjustment of the valve operating clearance, the outer wall 11 of the bucket portion 10 is formed with four diametrically opposed slots 11*a* which interrupt the ring of teeth 14 and by way of which a screw driver or other tool can be inserted to raise the head 17 of the insert portion 15 out of the recess in the top of the bucket portion 10 (see FIGS. 3 and 4). As shown in FIG. 5 the annulus of the bucket portion 10 is marked with scale graduations corresponding to a given axial adjustment of the foot or insert portion 15 on the valve stem 1, and the head 17 of the insert portion is marked with a datum arrow.

Figure 2:
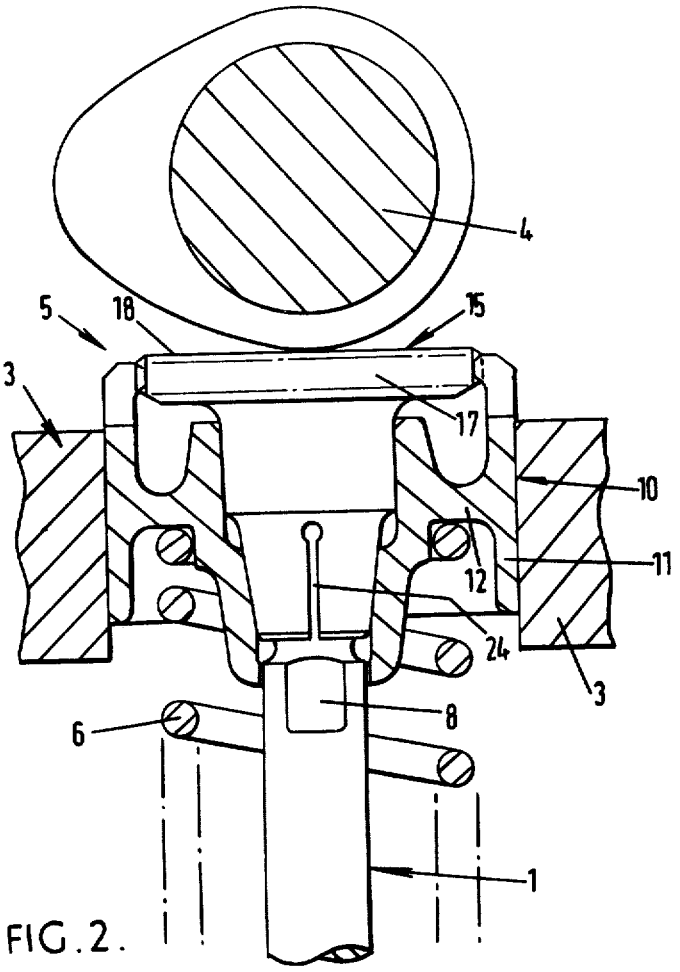
FIG. 2 is a further diametric section, orthogonal to that of FIG. 1.

Referring now in particular to FIGS. 1 and 2, the opening in the bucket portion 10 comprises a cylindrical bore 20 extending to a convergently tapered part 21. The stem of the insert portion 15 has a cylindrical neck portion 22 and a tapered tail portion 23, the latter being split by two diametrically opposite axially extending slits 24 which allow the reduction of the diameter of the screw thread 16 for the purpose previously mentioned herein.

Referring now specifically to the second embodiment illustrated in FIGS. 3 and 4, the opening in the bucket portion 10 comprises a plain cylindrical bore 30 formed with a shoulder 31 of reduced diameter at the bottom thereof. The stem of the insert portion 15 is cylindrical and has a tail portion 32 which is slit transversely to its axis, that is by slits 33 each of which extends partly around the circumference of the stem. The slits 33 allow for axial compression of the stem against shoulder 31 and hence reduction in the pitch of the screw thread 16 for the purpose previously mentioned herein.

What is claimed is:

1. A poppet valve assembly for an internal combustion engine, having a poppet valve urged against a valve seat by a valve return spring and featuring:

a. a tappet foot in screw thread engagement with the end of the valve stem and having locking formations; and b. a retainer collar non-rotatably engaged on a non-round section of the valve stem and having locking formations which inter-engage those of the tappet foot and which afford a plurality of alternative angular settings for the foot;

the retainer collar being displaceable against the valve return spring in order to disengage it from the foot for adjustment of the valve operating clearance.

2. A poppet valve assembly according to claim 1, in which the retainer collar has a ring of radial locking formations concentrically inter-engaging a ring of radial locking formations of the tappet foot.

3. A poppet valve assembly according to claim 2, in which the tappet foot has an internally screw-threaded, tapered stem that nests within a complementary, tapered central-opening portion of the retainer collar, and the stem of the foot is split axially so that it can grip the thread of the valve stem radially.

4. A poppet valve assembly according to claim 2, in which the tappet foot has an internally screw-threaded, cylindrical stem the end of which abuts an annular shoulder at the bottom of a cylindrical central-opening portion of the retainer collar, and the stem of the foot is slit circumferentially so that it can grip the thread of the valve stem axially.

5. A cylinder head for an internal combustion engine, having an overhead camshaft and including a poppet valve assembly according to claim 1 arranged for actuation by the camshaft.

* * * * *

UNITED STATES PATENT AND TRADEMARK OFFICE

CERTIFICATE OF CORRECTION

PATENT NO. : 3,941,102

DATED : March 2, 1976

INVENTOR(S) : Eric Gordon Bareham

It is certified that error appears in the above-identified patent and that said Letters Patent are hereby corrected as shown below:

[30] Foreign Application Priority Data

August 18, 1973 Great Britain.....39137/73

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*